US006516786B2

(12) United States Patent
Krimmer et al.

(10) Patent No.: US 6,516,786 B2
(45) Date of Patent: Feb. 11, 2003

(54) METHOD AND ARRANGEMENT FOR THROUGH-FLOW CONTROLLING FUEL VAPOR IN A TANK-VENTING SYSTEM OF A MOTOR VEHICLE

(75) Inventors: Erwin Krimmer, Pluederhausen (DE); Wolfgang Schulz, Bietigheim-Bissingen (DE); Helmut Schwegler, Pleidelsheim (DE); Georg Mallebrein, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/833,189

(22) Filed: Apr. 12, 2001

(65) Prior Publication Data

US 2001/0029934 A1 Oct. 18, 2001

(30) Foreign Application Priority Data

Apr. 12, 2000 (DE) ..... 100 18 209

(51) Int. Cl.[7] ..... F02M 33/02
(52) U.S. Cl. ..... 123/520; 123/516
(58) Field of Search ..... 123/520, 519, 123/518, 516, 198 D; 60/283, 285

(56) References Cited

U.S. PATENT DOCUMENTS 5,060,621 A * 10/1991 Cook et al. ..... 123/520
5,067,469 A * 11/1991 Hamburg ..... 123/520
5,873,350 A 2/1999 Wild et al. ..... 123/520
5,979,418 A * 11/1999 Saruwatari et al. ..... 123/519

FOREIGN PATENT DOCUMENTS

| | | |
|---|---|---|
| DE | 68910158 | 2/1994 |
| DE | 19647432 | 2/1998 |
| DE | 10015172 | 10/2000 |
| JP | 6-110556 | 4/1994 |
| JP | 07134619 | 5/1995 |

* cited by examiner

*Primary Examiner*—Willis R. Wolfe
*Assistant Examiner*—Mahmoud Gimie
(74) *Attorney, Agent, or Firm*—Walter Ottesen

(57) ABSTRACT

A control unit (50) makes a single control signal available for driving the through-flow control valves (TEV1, TEV2) (51, 52). Through-flow valve (TEV2) has a larger maximum through flow than through-flow control valve (TEV1). A delay circuit is indicated by the phantom outline (52') and is mounted at the valve stage TEV2 (52). The delay circuit includes an electric delay element (53) with the aid of which the original control signal is delayed in time by an amount Δt1 relative to the control signal of control valve (TEV1). The resulting delayed signal is supplied to an AND-gate (54) together with the original control signal. Accordingly, a control signal is present at the output of the AND-gate for the control valve (TEV2). The time delay makes possible the exclusive activation of the through-flow control valve (TEV1) (51) at low pulse duty factors. In this way, a high small quantity meterability is achieved. Starting at a specific pregivable switch-in time, the control valve (TEV2) (52) is switched in so that a very large through flow is possible. The invention thereby makes possible excellent meterability at low as well as at high through flows.

12 Claims, 3 Drawing Sheets

METHOD AND ARRANGEMENT FOR THROUGH-FLOW CONTROLLING FUEL VAPOR IN A TANK-VENTING SYSTEM OF A MOTOR VEHICLE

FIELD OF THE INVENTION

The invention relates to a method and an arrangement for controlling the through flow of fluid material especially of venting gases and vapors in a tank-venting system of a motor vehicle having an engine and a fuel supply tank.

Furthermore, the invention relates to a corresponding through-flow control valve as well as a control unit for operating such an apparatus.

BACKGROUND OF THE INVENTION

In motor vehicles, which are driven by internal combustion engines, a venting or aerating of the fuel supply tank is absolutely necessary for a trouble-free fuel flow. When fuel is consumed, air must be able to flow into the tank because otherwise a vacuum would form and the flow of fuel would become intermittent. The tank also has to be aerated to permit the contents of the tank to be able to expand when there is warming. In addition, when tanking, sufficient air must be able to exit from the tank so that the fuel added to the tank does not again bubble out of the fill stub.

In motor vehicles, tank venting systems are increasingly used wherein the vaporizing or excess fuel vapor is not conducted into the ambient but is directed via a venting line into an active charcoal filter. The fuel vapor or the fuel gas is there stored and is supplied during operation of the vehicle via a clocked controllable electromagnetic tank-venting valve to an intake manifold of the engine and therefore to the combustion. The maximum through flow in overcritical pressure relationships in the valve is mostly in the range of 3 to 6 kilograms per hour (kg/h). In this way, an emission of the environmentally-damaging fuel vapor from the tank into the ambient is substantially prevented and, at the same time, the fuel vapor, which is supplied to the engine, is itself utilized as fuel whereby the fuel consumption is significantly reduced at least from time to time.

In such tank-venting systems, the vapor quantity, which flows via the tank-venting valve, is varied, in most instances, in a controlled (open loop or closed loop) manner within pregiven limits in dependence upon the fuel concentration present at a particular time as well as on the then present rpm/load operating point of the engine. An adequately precise meterability of the vapor flow, which flows out via the tank-venting valve, must be guaranteed even for a comparatively low total air flow, which is inducted by the engine. Such a comparatively small total air flow takes place, for example, when the engine is operated at idle. So-called "clocked valves" are preferably used as such valves.

A problem of the known clocked valves with the above-mentioned high throughput is a deficient small-quantity meterability. A through flow of approximately 0.2 kg/h can only be adjusted with a large tolerance of approximately +/−0.1 kg/h. The reason for these large through-flow tolerances lies especially in the naturally occurring draw delay of the valves whose tolerance lies in the range of approximately +/−1 millisecond (ms). The draw delay is the time duration between the electrical drive of the clocked valve and its mechanical opening.

The clock frequency of the valves is the frequency of an electrical drive signal of the clocked valve. This clock frequency of the valve should not drop below 8 Hertz (Hz) in order to especially avoid a defective time-dependent even distribution for the operation of the valve.

A short number comparison should make the relationships somewhat clearer. Assuming the above-mentioned tolerance of +/−1 ms, with two valves with respectively different through flows (or maximum throughputs), a throughput of 0.12 kg/h should be attained. A clock frequency of 10 Hz is assumed for both valves. In one valve having a nominal throughput of 6 kg/h, a mechanical opening duration of the valve of 2 ms results which yields a through-flow tolerance of +/−50% for the assumed draw-delay tolerance. In contrast thereto, for a valve having a nominal throughput of 2 kg/h, a mechanical opening duration of 6 ms results and, therefore, a through-flow tolerance of comparatively only +/−16.6%. The opening duration or open time of a valve is defined as the time duration during which the valve is mechanically opened and a through flow can accordingly take place. The open time is the difference of the drive time and the draw delay already defined above.

With respect to the above tolerances, reference can be made to U.S. Pat. No. 5,873,350 which is incorporated herein by reference.

SUMMARY OF THE INVENTION

It is an object of the invention to provide a method and an arrangement of the kind described above wherein a meterability of the through flow as fine as possible for very low throughputs as well as for very high throughputs of fluid substances (gases, vapors, liquids, et cetera) is made possible. At the same time, the arrangement should be manufacturable and operable at favorable costs. The drive of such an arrangement should especially be possible with the least amount of technical complexity and not only with respect to a use in motor vehicles.

The method of the invention is for controlling the through-flow of fluid substances including venting gases and/or vapors in a tank-venting system of a motor vehicle having a fuel supply tank and an internal combustion engine. The method includes the steps of: generating a time-dependent clocked first through flow of a first through-flow amount; generating a time-dependent clocked second through flow with the first through flow being nominally less than the second through flow; and, switching in the second through flow at a time delay relative to the first through flow.

The method of the invention has the steps of generating a first time-dependent clocked through flow as well as at least a second time-dependent clocked through flow. The first through flow is nominally less than the second through flow and the second through flow is switched in delayed in time compared to the first through flow. For short drive times, the method makes possible an exclusive activation of the first through flow which is nominally less than the second through flow and accordingly permits a higher accuracy in the metering of smaller through-flow quantities. The drive time is defined as the time duration for the electrical drive of the clocked valve for opening the valve. With the short drive times (relative to the delay of switching in the second flow), small through-flow rates can be controlled with a high precision. Longer drive times lead to the situation that also the second through flow is activated. only by means of the longer drive times are higher through-flow rates made possible which are controllable with adequately high accuracy referred to these large through-flow quantities. In total, the method of the invention permits a precise through-flow control for low as well as for high through flows or through-flow rates.

With respect to fluid substances, it is noted that these include gases, vapors, liquids or other substances having good flow characteristics.

The arrangement according to the invention includes especially a first through-flow control valve having a first nominal through flow and a second or several through-flow control valves having a second nominal through flow. The first nominal through flow is less than the second nominal through flow. The first and the second through-flow control valves can alternatively define a first and an at least second valve stage of an at least two-stage through-flow control valve.

In addition, control means are provided for the time-dependent delayed driving of the at least second through-flow control valve or of the at least second valve stage relative to the first through-flow control valve or the first valve stage.

For low pulse-duty factors, that is, for relatively short opening durations of a through-flow control valve, the time-dependent delay makes possible the exclusive activation of the smaller of the two nominal through flows, namely, that having the first (smaller) through flow. In this way, a small quantity meterability is achieved which is significantly improved compared to the state of the art. Starting at a specific pregivable drive time, the larger or, if required, the next larger (second) nominal through flow is connected thereto so that a very large through flow is possible and this very large through flow is the algebraic sum of the two individual nominal through flows. The switching in of the second through flow only takes place for already significant through-flow values of the first valve. For this reason, the invention therefore makes possible a high meterability at low as well as at high through flows.

In addition to an embodiment having two valves or valve stages, it is emphasized that basically also three or several valves or valve stages can be considered. By increasing the number of valves or valve stages, it can be achieved that the jumps or non-uniformities in the through flows, which occur when switching in individual valves, can be minimized.

When used in a tank-venting system, the special advantage is afforded that the relative accuracy with which large as well as small quantities of fuel vapor or fuel gas can be metered varies less over the entire fuel quantity range than in conventional clocked valves. Especially for small amounts, the mixture errors for active tank venting are thereby reduced, that is, when opening the tank-venting valve in a controlled driven manner.

In a first embodiment, it is provided that the second through-flow control valve or the second valve stage has a delay element by means of which a time-dependent delayable second switch-on flank can be generated compared to a first switch-on flank of the first through-flow control valve or the first valve stage. The delay can, for example, be realized by means of an electrical delay circuit utilizing a relay, which is delayed in time corresponding to the switch-on flank. A hydraulic valve or the like can also be used. In this embodiment, the two through-flow control valves or the two valve stages are advantageously driven by means of only a single control signal whereby the number of control lines is reduced. The control signal is preferably transmitted via an electrical or hydraulic control line or the like to the valves or valve stages.

According to a second embodiment, the first through-flow control valve or the first valve stage can be driven by means of a first control signal and the second through-flow control valve or the second valve stage can be controlled by a second control signal which can be delayed in time with respect to the first control signal. With this embodiment, known through-flow control valves can be used in the realization and only the control unit needs to be exchanged.

In an advantageous embodiment, it is provided that the two through-flow control valves or the two valve stages have respective separate electric drive coils which can be driven separately. This makes possible a technically relatively simple independent control of the two valves whereby costs are reduced.

The arrangement according to the invention can be used in a tank-venting system of an internal combustion engine having a charger mounted in the intake manifold. Fuel vapors escaping from the fuel tank can be introduced into the intake manifold at a first inlet location arranged behind the charger, with this first inlet location being provided on the intake manifold. According to the invention, a second inlet location for introducing fuel vapor is provided. This second inlet location is provided in a region of the intake manifold arranged forward of the charger. Especially at high engine loads or rpms (especially for an active turbocharger), the regeneration of the fuel vapor and fuel gas is thereby considerably facilitated.

A corresponding two-stage or multiple-stage through-flow control valve (especially a tank-venting valve of an internal combustion engine having a fuel supply tank) includes a delay element for generating a time-dependent delayable switch-on flank. The delay element is arranged at the valve or valve stages with the higher nominal through flow. With the arrangement of the delay element at this valve, the number of required control lines can be reduced for the reasons already mentioned herein.

The control unit, which is likewise suggested in accordance with the invention, is for operating such an arrangement and includes a signal generator in a first embodiment. This signal generator is for making available a control signal, which can be pulsewidth modulated, for driving the two through-flow control valves or the two valve stages. Such a control unit is suitable to operate a through-flow control valve wherein the required delay circuit is already present.

According to a second embodiment, the control apparatus includes a signal generator device for generating a first control signal for driving a first through-flow control valve or the first through-flow control valve stage as well as a second control signal for controlling the second through-flow control valve or the second valve stage. The control apparatus also includes an electrical switching device for generating a time-dependent delay of the second control signal relative to the first control signal. For this purpose, conventional through-flow control valves can be used.

The time-dependent delay between driving the two through-flow control valves or valve stages preferably lies in the range of approximately 10 to 50 milliseconds.

It is emphasized that, in contrast to the two-stage tank-venting valves (which are known from the prior art and have three connecting lines, two control lines plus a ground line), the first embodiment according to the invention has only two lines and these are a control line and a ground line. In this way, costs for a second control line are saved and, in addition, the weight of the vehicle is reduced. Furthermore, a second output stage of the control apparatus is unnecessary because only a single control signal need be generated. On the other hand, only costs for the above-mentioned delay circuit need be expended.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
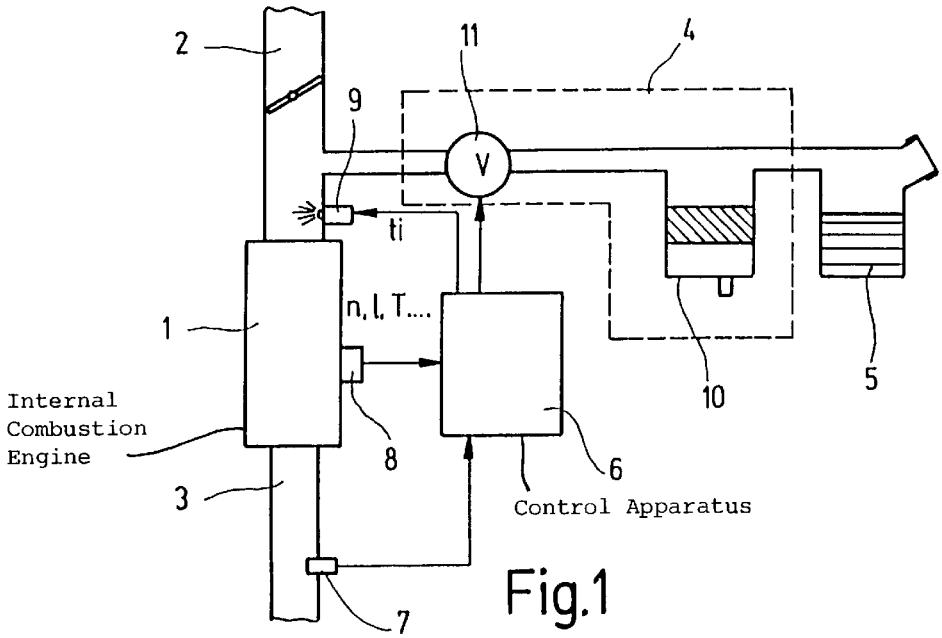
FIG. 1 is a schematic of an internal combustion engine having a tank-venting system and being suitable for use with the arrangement according to the invention.

FIG. 1 shows an internal combustion engine 1 which is especially an engine of a motor vehicle. The engine 1 includes an intake manifold 2, an exhaust-gas system 3, a tank-venting system 4, a fuel supply tank 5, a control apparatus 6, an exhaust-gas sensor device 7 and a sensor assembly 8, which represents a plurality of sensors which determine the operating parameters of the engine. These sensors include an rpm sensor, a flow sensor for sensing the inducted air quantity, a temperature sensor, et cetera. In addition, a fuel metering device 9 is provided which can be especially realized as an arrangement of one or several injection valves.

The tank-venting system 4 includes an active charcoal filter 10 which communicates via corresponding lines and connections with the tank 5, the ambient air and the intake manifold 2 of the engine 1. A tank-venting valve (V) 11 is mounted in the line to the intake manifold 2. The active charcoal filter 10 stores fuel vaporized in the tank 5. Air is inducted from the ambient through the active charcoal filter 10 when the tank-venting valve is driven by the control apparatus 6 to open and the active charcoal filter releases the stored fuel to the inducted air. This air/fuel mixture is characterized as a "tank-venting mixture" or as "regenerating gas" and influences the composition of the gas mixture supplied in total to the engine 1. The gas mixture supplied to the engine is determined in part by a metering of fuel via the fuel metering device 9. This metering of fuel is adapted to the inducted air quantity. In extreme cases, the fuel inducted via the tank-venting system 4 to the intake manifold 2 can correspond to a component part of approximately one third to one half of the entire fuel quantity.

Figure 2:
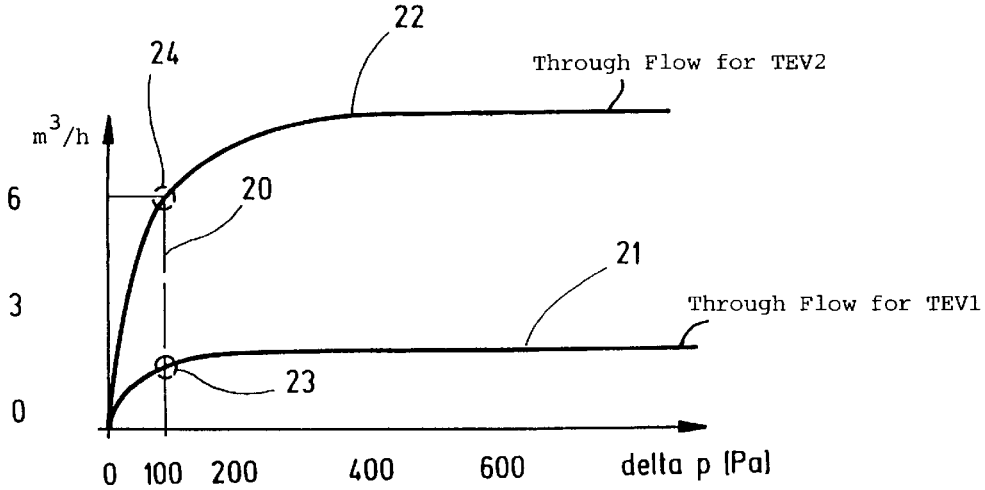
FIG. 2 shows typical characteristic lines of two through-flow control valves having respectively different nominal through flows.

FIG. 2 shows typical characteristic lines of two clocked controllable through-flow control valves having respectively different nominal through flows which are suitable for use in the arrangement according to the invention. It is again emphasized that, in a first embodiment of the invention (FIG. 4*a*), such valves can be used without technical modifications being required; whereas, in a second embodiment (FIG. 4*b*), a delay element is arranged at least on the valve or the valve stage having the higher nominal throughput. Referring again to FIG. 2, the nominal or maximum throughput 20 is computed (points 23, 24) for a pressure difference of 100 Pascal (Pa) and therefore lies at approximately 1.4 $m^3/h$ for the valve (TEV1) 21 and at approximately 6.0 $m^3/h$ for the second valve (TEV2) 22. From the characteristic lines, it can be seen that the through flow increases greatly only for small pressure differences and then becomes notably flatter at the height of the value of the nominal through flow in order to go over into a saturation curve.

Figure 3:
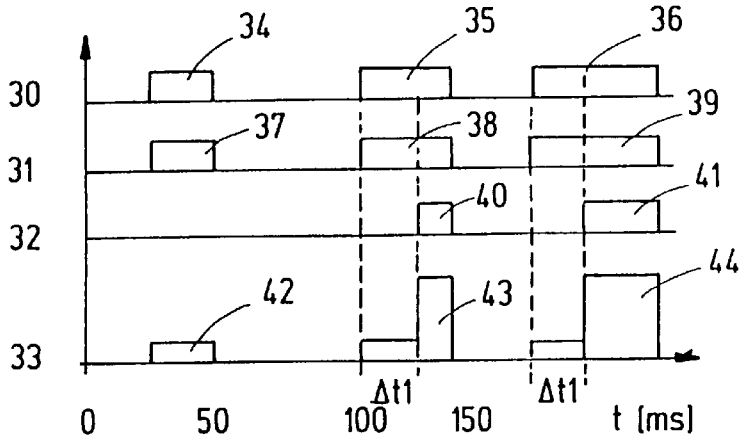
FIG. 3 shows a set of waveforms of drive control signals as well as corresponding through flows of a two-stage tank-venting valve in accordance with the invention.

The time characteristic of pulsewidth modulated control signals and the corresponding through flows of a two-stage venting valve according to the invention is shown in FIG. 3 with respect to a pulse-time diagram. The subdiagram 30 presents a series of drive pulses of a drive signal which are outputted, for example, by a control unit according to the invention. The shortest time duration is 100 ms corresponding to a maximum clocked frequency of 10 Hz. The duration of the pulse 34 is approximately 20 ms and the duration of the pulse 35 is approximately 30 ms and the duration of the pulse 36 is approximately 40 ms.

In the two subdiagrams 31 and 32, it is shown how the valve stages TEV1 and TEV2, respectively, respond to the above-described pulse sequence. According to the invention, the valve stage TEV1 has no delay element, that is, the drive signal therefor is not otherwise delayed, for example, by the control unit relative to the drive signal of the valve stage TEV2. For this reason, and except for an initial time-dependent delay (not shown), the response characteristic (valve completely open) 37 to 39 of TEV1 corresponds essentially to the pulse sequence 34 to 36. In contrast, the positive flank of the drive signal 32 at valve stage TEV2 arrives with a pregiven time delay $\Delta t1$ relative to the drive signal 31 of valve stage TEV1 whereby a response characteristic (40, 41) adjusts at valve stage TEV2.

In the lower component diagram 33, the through flow which results in total from both response patterns (31, 32) is shown through the two valve stages TEV1, TEV2. Here, the very different nominal through flows of the valve stages can be seen whereby, with drive times of up to approximately 25 ms and, because of the exclusive response of TEV1, a high meterability results exclusively by means of the pulsewidths and, for longer drive times, relatively high gas throughputs are possible because of the switching in of TEV2.

For a maximum period duration of approximately 100 ms, one can approximately meter continuously up to a pulse duty factor of 75% for TEV2 as well as up to a pulse duty factor of 95% for TEV1. The total through flow at this operating point amounts to $0.75 \cdot 6$ kg/h+$0.95 \cdot 2$ kg/h=6.4 kg/h. For a pulse duty factor of 100% (that is, a 100% electric feed of both valves TEV1 and TEV2), the through flow quantity then jumps to 8 kg/h.

Figure 4A:
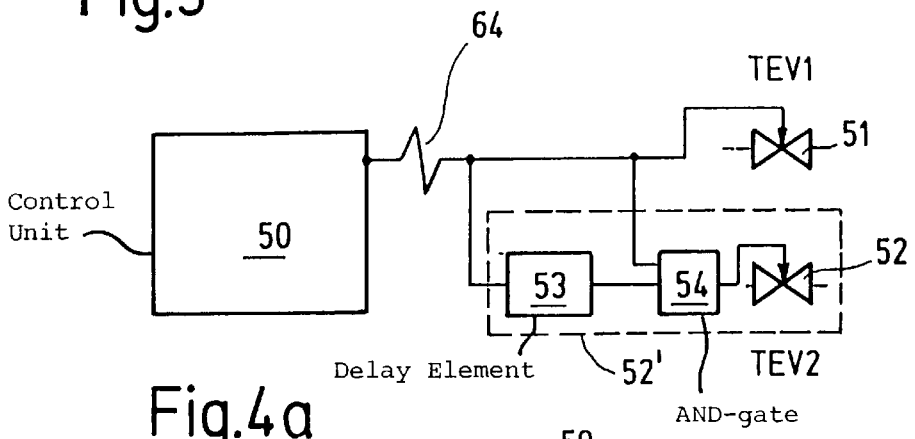
FIGS. 4*a* and 4*b* show respective embodiments for generating the drive of a valve stage for the drive signals (shown in FIG. 3) of the two-stage tank-venting valve with the drive signals being time delayed in accordance with the invention.

The block diagram shown in FIG. 4*a* presents a first embodiment for generating the time-delayed drive of a stage of the two-stage tank-venting valve shown in FIG. 3. The arrangement includes a control unit 50, which is built in a manner known per se. The control unit 50 makes available a common control signal for both through-flow control valves (51, 52). The delay circuit required in accordance with the invention is, in this embodiment, mounted at the valve stage 52 itself and is indicated by the broken line 52'. This affords, inter alia, the advantage that only a single signal line 64 is required up to the valves. The delay circuit includes an electrical delay element 53 with which the original control signal is time delayed by $\Delta t1$. The resulting delayed signal is supplied to an AND gate 54 together with the original control signal. A signal corresponding to the pulse sequence (40, 41) in FIG. 3 is then present at the output of the AND gate 54.

Figure 4B:
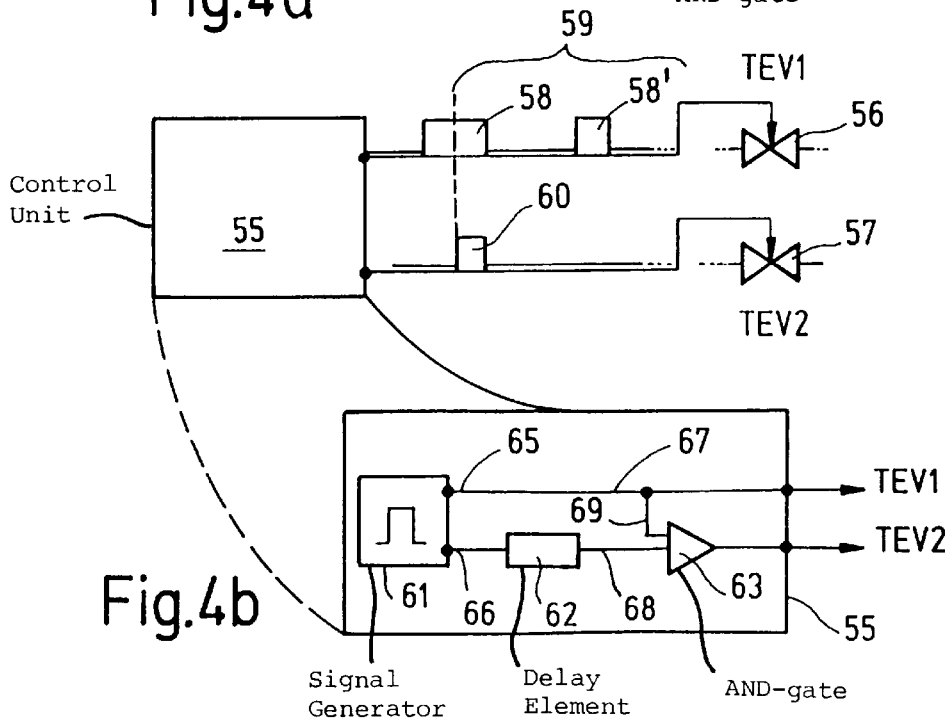

A second variation for making available a time-delayed drive in accordance with the invention is shown in the block diagram of FIG. 4*b*. In this embodiment, the required delay circuit is integrated into a control unit 55. For this reason, through-flow control valves (56, 57), which are known from the state of the art, can be used. The drive signals (59, 60) in accordance with the invention therefore lie already at the two output lines. In the drive signal 59, two drive pulses (58, 58') are shown of respectively different period durations.

The detail enlargement of FIG. 4*b* shows the function elements for generating the signal delay in accordance with the invention which are provided in the control unit 55. A signal generator 61 supplies an identical pulsewidth-modulated output signal at two outputs (65, 66). This output signal is supplied unchanged to valve TEV1 via a line 67. The second output signal 66 is first supplied to a delay element 62. The signal 68 present at the output of the delay element 62 is supplied, together with the original signal 69, to an AND gate 63. The output signal of the AND gate then defines the drive signal for TEV2.

It is noted that the above-described electrical control devices can also be realized as a hydraulic or pneumatic control or the like. The electrical delay circuits can also be formed by digital delay members. The proposed valve technique can be used not only in tank-venting systems, but also everywhere where substance flows with high as well as low through flows are generated by means of clocked through-flow valves and where a high meterability is to be afforded in the entire through-flow range.

Figure 5:
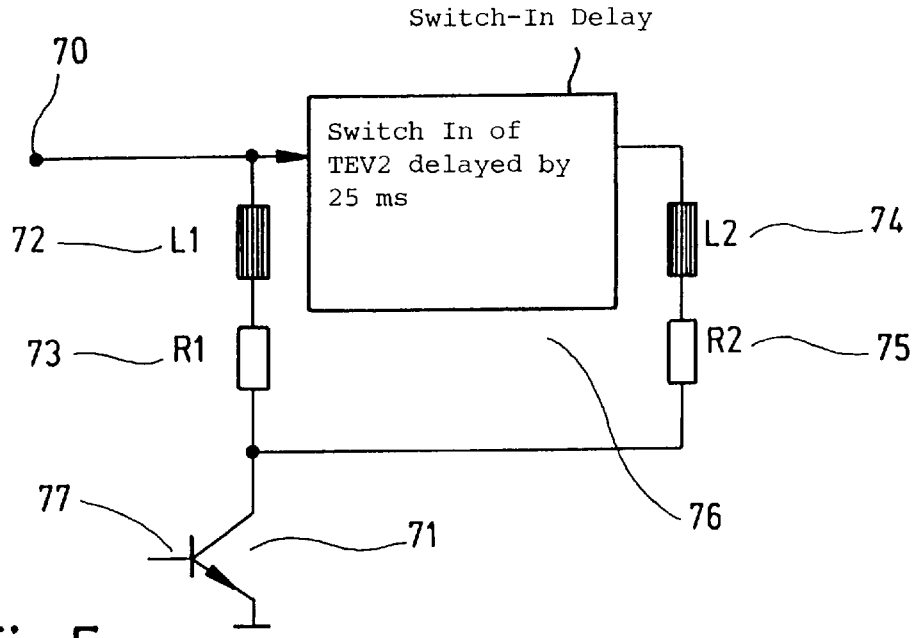
FIG. 5 is a circuit diagram of an exemplary electrical circuit of the two tank-venting valves in accordance with the invention; and, FIG. 6 shows a second inlet location in accordance with the invention for introducing fuel vapors at a region of an intake manifold arranged forward of a turbocharger.

An exemplary electrical circuit of the two tank-venting valves according to the invention is shown in FIG. 5. The circuit shows a switching transistor 71 which supplies current to a resistance-inductive load (72, 73) of a small tank-venting valve TEV1 when the base 77 of the transistor is driven. The resistance-load (74, 75) of the larger tank-venting valve TEV2 is opened in a delayed manner by about 25 ms with the aid of a switch-in delay 76 while TEV1 is still driven.

Figure 6:
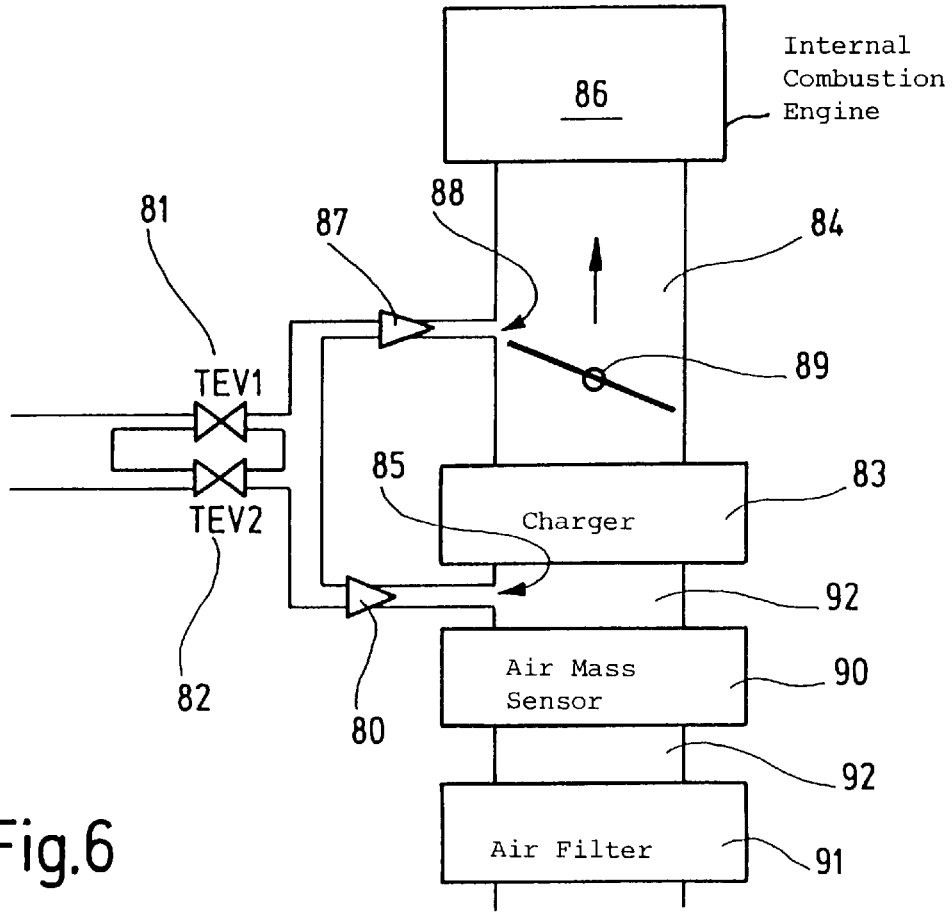

FIG. 6 shows an arrangement according to the invention wherein a part 80 of the fuel venting gases, which are metered by the valves TEV1 81 and TEV2 82, is supplied at a second inlet location 85 in the intake manifold to an internal combustion engine 86 for combustion. The inlet location 85 opens into an intake manifold 84 ahead of a turbocharger 83. The other part 87 of the fuel venting gases is supplied to the internal combustion engine 86 at a conventional inlet location 88, that is, in the flow direction rearward of the throttle flap 89. An air mass sensor 90 and an air filter 91 are mounted along the intake channel 92.

It is understood that the foregoing description is that of the preferred embodiments of the invention and that various changes and modifications may be made thereto without departing from the spirit and scope of the invention as defined in the appended claims.

What is claimed is:

1. A method for controlling the through flow of fluid substances including venting gases and/or vapors in a tank-venting system of a motor vehicle having a fuel supply tank and an internal combustion engine, the method comprising the steps of:

generating a time-dependent clocked first through flow of a first through flow amount;

generating a time-dependent clocked second through flow of a second through flow amount with said first through flow amount being nominally less than said second through flow amount; and, switching on said second through flow at a time delay relative to said first through flow.

2. An arrangement for controlling the through flow of a fluid substance including venting gases and/or vapors in a tank-venting system of a motor vehicle having a fuel supply tank and an internal combustion engine, the arrangement comprising:

first through-flow control valve means for passing a first nominal through flow amount;

second through flow control valve means for passing a second nominal through-flow amount with said first nominal through flow amount being less than said second nominal through flow amount; and, control means for switching on said second through-flow control valve means at a time delay relative to said first through-flow control valve means.

3. The arrangement of claim 2, wherein said first through-flow control valve means includes a first through-flow control valve or a first valve stage of at least a two-stage through-flow control valve; and, said second through-flow control valve means including a second through-flow control valve or a second valve stage of at least a two-stage through-flow control valve.

4. The arrangement of claim 2, wherein said control means includes a control unit for generating a single control signal for driving said first through-flow control valve means and said second through-flow control valve means and said single control signal including a pulse having a first switch-on flank; and, said second through-flow control valve means including a switch-on delay unit for generating a second switch-on flank delayed in time relative to said first switch-on flank.

5. The arrangement of claim 2, wherein said first through-flow control valve means is driven by a first control signal and said second through-flow control valve means is driven by a second control signal having a positive flank delayed in time relative to said first control signal.

6. The arrangement of claim 2, wherein said first and second through-flow control valve means have respective separate electrical drive coils separately driveable.

7. The arrangement of claim 2, wherein said internal combustion engine includes an intake manifold and a charger mounted in said intake manifold; a first inlet location arranged in said intake manifold downstream of said charger; a second inlet location arranged in said intake manifold upstream of said charger; and, said tank-venting system including a first connection to said first inlet location for introducing a first part of said venting gases and/or vapors into said intake manifold downstream of said charger and a second connection to said second inlet location for introducing a second part of said venting gases and/or vapors into said intake manifold upstream of said charger.

8. The arrangement of claim 2, wherein said control means includes a signal generator for providing a pulse width modulated control signal for driving said first and second through-flow control valve means.

9. The arrangement of claim 2, wherein said control means includes signal generating means for generating a first control signal for driving said first through-flow control valve means and for generating a second control signal for driving said second through-flow control valve means; and, circuit means for generating a time-dependent delay of said second control signal relative to said first control signal.

10. The arrangement of claim 9, wherein said time-dependent delay is in the range of 10 to 50 milliseconds.

11. A through-flow control valve comprising a first valve stage having a first nominal through flow amount driveable by a first switch-on flank and a second valve stage having a second nominal through flow amount; said first nominal through flow amount being less than said second nominal through flow amount; and, a delay element mounted at said second valve stage for generating a switch-on flank delayed in time relative to said first switch-on flank.

12. The through-flow control valve of claim 11, wherein said through-flow control valve is a tank-venting valve of a vehicle having a fuel supply tank.

* * * * *